166-308
6/29/76 XR SR 3,965,982

United States Patent [19]

Medlin

[11] 3,965,982

[45] June 29, 1976

[54] HYDRAULIC FRACTURING METHOD FOR CREATING HORIZONTAL FRACTURES

[75] Inventor: William L. Medlin, Dallas, Tex.

[73] Assignee: Mobil Oil Corporation, New York City, N.Y.

[22] Filed: Mar. 31, 1975

[21] Appl. No.: 563,886

[52] U.S. Cl. ..... 166/249; 166/308

[51] Int. Cl.[2] ..... E21B 43/26

[58] Field of Search ..... 166/249, 308

[56] References Cited

UNITED STATES PATENTS

| | | | |
|---|---|---|---|
| 2,871,943 | 2/1959 | Bodine, Jr. | 166/249 |
| 2,915,122 | 12/1959 | Hulse | 166/249 |
| 3,048,226 | 8/1962 | Smith | 166/249 X |
| 3,130,552 | 4/1964 | Bodine, Jr. | 166/249 X |
| 3,195,634 | 7/1965 | Hill | 166/308 X |
| 3,602,308 | 8/1971 | Vincent | 166/308 X |
| 3,602,311 | 8/1971 | Whitsitt | 166/308 |
| 3,822,747 | 7/1974 | Maguire, Jr. | 166/308 X |
| 3,842,907 | 10/1974 | Baker et al. | 166/249 |
| R23,381 | 6/1951 | Bodine, Jr. | 166/249 |

OTHER PUBLICATIONS

"The Determination of Tectonic Stresses through Analysis of Hydraulic Well Fracturing" Kehle, Ralph O., Journal of Geophysical Research, vol. 69, No. 2, Jan. 15, 1964, pp. 259–273.

von Schonfeldt, H. and Fairhurst, C., "Open Hole Hydraulic Fracturing," Third Symposium on Salt, vol. 2, The Northern Ohio Geological Society, Inc., Cleveland, Ohio, pp. 404–409.

*Primary Examiner*—Stephen I. Novosad
*Assistant Examiner*—George A. Suckfield
*Attorney, Agent, or Firm*—C. A. Huggett; Henry L. Ehrlich

[57] ABSTRACT

This specification discloses a method of creating a horizontally disposed fracture in a subterranean formation that is penetrated by a wellbore. Two packers are set in the wellbore against the formation to be fractured to define with the wellbore and intermediate the packers a fracture treatment zone. Hydraulic pressure is applied to the fracture treatment zone in an amount slightly less than that required to create a vertical fracture in the formation. Acoustical energy is applied in the fracture treatment zone to form a resonant condition therein and to provide rigid coupling of acoustic stress pulses between the packer and the formation and form a horizontal fracture in the formation. The horizontal fracture is propagated into the formation by the continued application of the hydraulic pressure to the fracture treatment zone.

5 Claims, 1 Drawing Figure

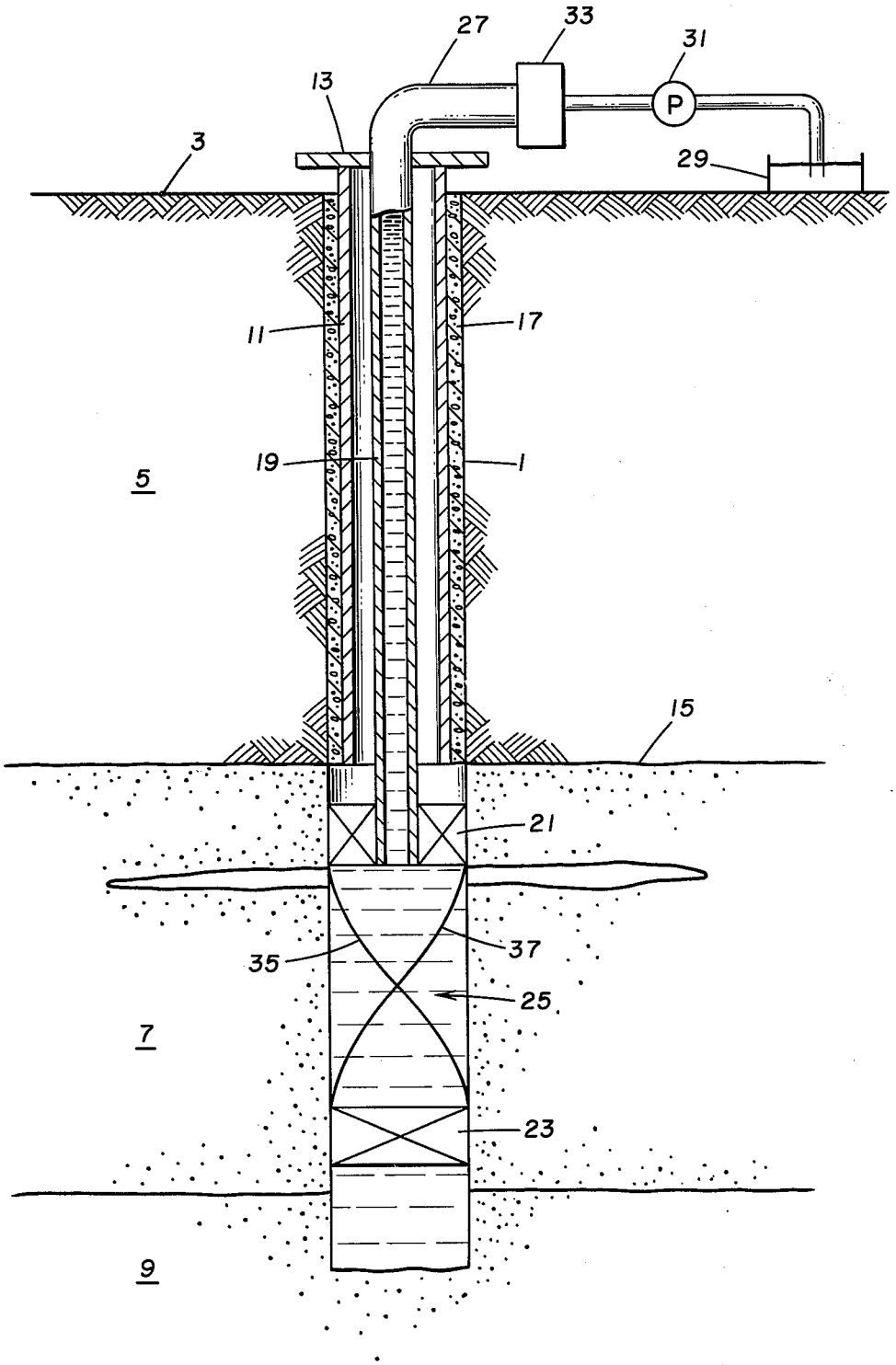
27
33
31
13
P
3
29
11
17
19
1
5
15
21
35
37
25
7
23
9

HYDRAULIC FRACTURING METHOD FOR CREATING HORIZONTAL FRACTURES

BACKGROUND OF THE INVENTION

This invention relates to the fracturing of subterranean formations and more particularly relates to a method for forming a horizontally disposed fracture in a subterranean formation by the combined application of hydraulic pressure and acoustical energy.

Methods of fracturing subterranean formations penetrated by boreholes by the application of hydraulic pressure are well known. It is generally accepted that at depths greater than about 2000 to 3000 feet vertical fractures are normally preferentially formed in subterranean formations rather than horizontal fractures by hydraulic fracturing techniques.

Methods of fracturing subterranean formations by the combined application of hydraulic pressure and acoustical energy are also shown in the prior art. In U.S. Pat. No. 2,915,122 there is described a method for hydraulically fracturing a subterranean formation penetrated by a wellbore wherein a plurality of mechanically induced pressure shocks are applied to a low penetrating fluid that is pumped via a wellhead into the wellbore. The pressure shocks are applied directly to the column of liquid at the wellhead by means of an air hammer or a piston or other suitable apparatus. The pressure shocks may be applied to the column of liquid as the pressure of the liquid is increased to the formation breakdown pressure, or may be applied when the formation breakdown pressure is reached and fissures are formed in the formation or may be applied continuously as the fluid pressure increase is begun and throughout the entire period of pressure application. In U.S. Pat. No. 3,602,311 there is described a process for fracturing a subsurface formation wherein a first path of flow of a fracturing fluid is established from a pump through a flow control-hammer valve and a second path of flow is established to the formation to be fractured from a point between the pump and the valve, the pressure of the fluid against the formation from the second path of flow being controlled at a predetermined level, preferably slightly less than the formation fracture pressure. Next, the flow through the valve is instantaneously terminated to cause a pressure pulse to be transmitted through the second path of flow and against the formation and to cause fracturing thereof.

In U.S. Pat. No. 3,842,907 there is disclosed an acoustical well fracturing method and apparatus whereby pressure fluctuations are generated in a wellbore by pumping fluid through a first conduit to drive an acoustical oscillator coupled with an acoustical compliance that transmits the pressure fluctuations to a formation of the earth in a selected zone of the wellbore. The wellbore which functions as a second conduit that contains the first conduit and the oscillator returns fluid flow back toward a pump means. A variable restriction means is used to adjust the back pressure in the wellbore such that the maximum oscillated fluid pressure exceeds that pressure required for a formation fracture. To achieve fracture only in the selected zone, acoustical isolation means are spaced above and below the acoustical oscillator to confine the pressure fluctuations to that zone.

An article by Ralph O. Kehle entitled "The Determination of Tectonic Stresses through Analysis of Hydraulic Well Fracturing," Journal of Geophysical Research, Vol. 69, No. 2, Jan. 15, 1964, pp. 259–273, considers the problem of the determination of the magnitudes of the components of the tensile stress at a point in the earth's crust. This determination is made using data that is normally obtained during a hydraulic well-fracturing operation. The well-fracturing operation is modelled by a band of uniform pressure and two bands of uniform shear stress acting in a cylindrical cavity in an infinite body. The model is an open hole well-fracturing treatment wherein the prospective producing horizon is packed off and fluid is introduced into this zone. The fluid pressure is increased to a maximum value at which time the formation fractures. Fluid continues to be pumped into the zone, and the pressure stabilizes at a value, the flowing pressure, which commonly is intermediate to the formation fluid pressure and the breakdown pressure. The fracturing fluid induces a uniform pressure over the packed-off interval. The effect is modelled exactly by a uniform band of pressure in a cylindrical hole. The pressure also tends to force the packers away from the pressurized interval, but any such movement of the packers is prohibited by frictional forces that arise at the contact between the packers and the wall of the borehole.

It is stated that two interesting regions of induced stress are: either end of the pressurized interval where the tangential stress is zero (the vertical stress is approximately 95 percent of the pressure) and the center of the packed-off interval where the tangential stress equals the pressure (the vertical stress is zero). The tectonic stresses are the overburden load and two unknown principal horizontal stresses that cause easily determined stress concentrations at the wellbore. All calculated stresses are modified to account for the interstitial pore-fluid pressure. It is found that three situations are of interest: (1) the induced vertical stress is less than the overburden pressure; (2) the induced vertical stress and the instantaneous shut-in pressure are greater than the overburden pressure; (3) the induced vertical stress is greater than the overburden pressure, but the instantaneous shut-in pressure is less than the overburden pressure. In (1) the fracture is vertical and the stresses are determinable. In (2) the fracture is horizontal and the stresses are indeterminable. In (3) the fracture is initially horizontal but becomes vertical as it propagates from the well, the vertical and minimum horizontal compressions are determinable, and the other principal stress is bounded by a set of inequalities.

In another article by H. von Schonfeldt and C. Fairhurst, entitled "Open Hole Hydraulic Fracturing," Third Symposium on Salt, Volume Two, The Northern Ohio Geological Society, Inc., Cleveland, Ohio, pp. 404–409, the basic principles of hydraulic fracturing in an open hole are discussed. The pre-existing regional stresses produce stress concentrations close to the borehole with a maximum value and a minimum value in tangential directions and at right angles one to the other. If a section of the borehole is sealed or packed off and pressurized, a second stress system will be superimposed upon the one just described. Two regions in the sealed interval to be considered are the central part of the hole section and the region close to the packers. It is stated that according to Kehle's model we arrive by superposition of the two active stress systems in the packed-off borehole section at certain expressions for the net minimum pressure (least compression). Expressions are then derived for the tangential stress in the central region and the axial stress in the region close to the packers. It is stated that a fracture is assumed to initiate at whichever point the appropriate strength of the rock is first reached. Under these assumptions expressions are then derived for the pressures which result in (1) a fracture parallel to the borehole axis (vertical fractures), and (2) a fracture normal to the borehole axis (horizontal fracture). It is then stated that if pressurized, deformable packers are used, Kehle's model will no longer be valid in the vicinity of the packers. This means that little or no axial tension is generated, thus requiring a much higher pressure for the initiation of horizontal fractures. Before such a high pressure is reached, however, a fracture will be initiated vertically.

SUMMARY OF THE INVENTION

This invention is directed to a method of forming a horizontally disposed fracture in a subterranean formation that is penetrated by a borehole. An upper packer and a lower packer are set in the borehole against the formation to form a packer-to-formation bond with the wall of the formation and to define with the borehole and intermediate the packers a fracture treatment zone. Hydraulic pressure is applied to the fracture treatment zone in an amount slightly less than that pressure required to create a vertical fracture in the formation. Acoustical energy is applied in the fracture treatment zone at a frequency to form a resonant condition therein and rigidly couple the upper packer and the lower packer with the wall of the formation and form a horizontal fracture in the formation. The horizontal fracture is propagated into the formation by continuing to apply hydraulic pressure to the fracture treatment zone.

BRIEF DESCRIPTION OF THE DRAWING

The drawing shows a borehole penetrating the earth and illustrates the method of the invention for forming a horizontal fracture in a subterranean formation.

DESCRIPTION OF THE PREFERRED EMBODIMENTS

This invention relates to a method of fracturing a subterranean formation and more particularly relates to a method of forming a horizontally disposed fracture in a subterranean formation which has a preferred vertical fracture orientation.

In accordance with an embodiment of this invention for fracturing in an open hole, a borehole is provided which extends from the surface of the earth and communicates with a subterranean formation that has a preferred vertical fracture orientation and into which it is desired to create a horizontal fracture. Two packers are set in the borehole to define with the borehole and intermediate the packers a fracture treatment zone. The packers are set against the formation to form a packer-to-formation bond with the wall of the formation. Fluid communication is provided intermediate the fracture treatment zone and the surface of the earth. This fluid communication is normally provided by positioning a tubing string in the well which extends from the surface of the earth and through the packer which defines the upper end of the fracture treatment zone. A liquid fracturing fluid is pumped down the well and into the fracture treatment zone and hydraulic pressure is applied to the formation in an amount slightly less than that pressure which would result in creating a vertical fracture in the formation. Acoustical energy is applied to the fracture treatment zone at a frequency to form a standing wave in the fracture treatment zone and lend rigidity to the packer-to-formation bond. Under application of acoustic energy the bond between the packer and the formation loses much of its resiliency and provides a rigid coupling of acoustic stress pulses to the formation rock. This behavior is a natural consequnce of strain rate considerations. It is well known in mechanics that resiliency is related to rate of strain. A material which is quite resilient at low strain rate is much more rigid at high strain rate. At the very high strain rates associated with acoustic frequencies most materials are rigid compared to their behavior under static loading. If acoustic energy is applied to the packers under resonant conditions a standing wave is generated between the packers. Stress pulses are then applied to the packers with maximum efficiency and are transferred to the formation as if the bond between packer and formation was rigid. Under these conditions the rigidity assumed in the aforementioned Kehle's model is applicable and horizontal fracturing is favored.

The amplitude of the applied acoustical energy is maintained at a relatively low value and is limited such that the combined pressure in the fracture treatment zone resulting from the hydraulic pressure and the acoustical energy is slightly less than that pressure required to form a vertical fracture in the formation. The increased rigidity of the packer-to-formation bond at acoustic frequencies provides rigid stress coupling between packer and formation. Thus, the vertical component of the hydraulic pressure which is applied to the packers is transferred with minimum loss to the formation and results in application of a vertical stress to the formation which, when combined with the hydraulic pressure, results in generating a horizontal fracture in the formation. The horizontal fracture is propagated into the formation by continuing to apply hydraulic pressure to the fracture treatment zone and preferably simultaneously applying the acoustical energy to the fracture treatment zone.

Referring now to the drawing, there is shown a wellbore 1 which extends from the surface 3 through an overburden 5, a productive formation 7, and is bottomed in underlying formation 9. Casing 11 is set in the wellbore and extends from a casinghead 13 to about the interface 15 between the overburden and the productive formation. The casing 11 is held in the wellbore by a cement sheath 17 that is formed between the casing 11 and the wellbore 1. A tubing string 19 is positioned in the wellbore and extends from the casinghead 13 through a first or upper packer 21 which is set in the wellbore against the wall of the productive formation 7. A second or lower packer 23 is also set in the wellbore against the wall of the productive formation 7. The upper packer 21 and lower packer 23, along with the wellbore 1, define a fracture treatment zone 25. The upper end of the tubing 19 is connected via a conduit 27 to a source 29 of fracturing fluid. A pump 31 is provided in communication with the conduit 27 for pumping the fracturing fluid from the source 29 down the tubing 19 of wellbore 1 and into the fracture treatment zone 25. An acoustical generator 33 is provided in communication with the conduit 27 for transmitting acoustical energy through the fracturing fluid down the tubing 19 and applying the acoustical energy to the fracture treatment zone 25.

The packers 21 and 23 that are set in the wellbore 1 may be straddle packers or other packers of the type normally used in wellbores and which may be expanded to form a bond with the wellbore or with a conduit positioned in the wellbore. The packers 21 and 23 preferably are spaced in the wellbore one from the other a distance of at least 1 foot and more preferably are spaced one from the other a distance of from 10 to 100 feet.

In accordance with an embodiment of this invention, hydraulic pressure is applied to the fracture treatment zone by pumping a fracturing fluid from the source 29 of fracturing fluid via pump 31 and tubing 19 into the fracture treatment zone 25. Hydraulic pressure is applied to the fracture treatment zone 25 in an amount of slightly less than that pressure which would result in the creating of a vertical fracture in the formation 7. The hydraulic pressure at which a fracture is initiated in a formation is referred to as the breakdown pressure and the approximate breakdown pressures of formations in a particular area are often known from prior experience or, if not, may be obtained by fracturing the formation in nearby wells and observing the pressure required to initiate a fracture therein. Acoustic energy is generated by the acoustic generator 33, is transmitted via the column of fracturing fluid in the tubing 19, and is applied to the fracture treatment zone 25. The acoustic generator 33 may be located at the surface, as indicated in the drawing, or may be located downhole. Both surface-located and downhole-located acoustic generators have been described in the prior art for use in wells. The frequency of the acoustic energy is regulated to establish a resonant condition as illustrated by the curves 35 and 37 in the fracture treatment zone 25. At resonance a standing wave is generated in the liquid column within the fracture treatment zone 25 whose half-wave length is an integral multiple of the distance between the packers. The resonant frequency in this embodiment depends upon the acoustical velocity of the fracturing fluid in the fracture treatment zone 25, the spacing between the packers 21 and 23, and the integral multiple employed. Normally the resonant frequency employed in this embodiment is within the range of 10 to 1000 cycles per second.

The standing wave formed in the fracturing fluid in the fracture treatment zone by the acoustical energy applies pressure to the packers 21 and 23 and makes the bond between the packers and the formation wall behave as a rigid coupling. The hydraulic pressure in the formation treatment zone 25 is applied vertically to the packers 21 and 23. This vertical component of pressure is transferred via the rigidly coupled packer-to-formation bond to the formation 7. This pressure creates a stress in the formation 7 which, when combined with the hydraulic pressure applied in the formation treatment zone, results in forming a horizontally disposed fracture in the formation. This horizontally disposed fracture is propagated into formation 7 by the continued application of hydraulic pressure and preferably the simultaneous application of the acoustical energy. The horizontally disposed fracture, if propagated sufficiently far into the formation, may tend to rotate and become a vertically disposed fracture. It is thought that the continuous application of the acoustical energy, along with the hydraulic pressure in propagating the fracture, serves to extend the distance that the horizontally disposed fracture is propagated into the formation.

This invention has been described primarily with reference to an open-hole fracturing process. It is also applicable, however, for use in cased boreholes. In carrying out this invention in a cased borehole, a slot is cut through the casing and surrounding cement sheath and one of the two packers is set in this slot to form a packer-to-formation bond. The second packer may be set against the casing or, if desired, a second slot may be formed such that the second packer is also set against the formation. This invention is then carried out as previously described. The packer-to-formation bond is made to behave as a rigid coupling by the acoustic energy as previously described and the horizontal fracture is formed in the formation in the vicinity of the packer.

In still another embodiment of this invention wherein casing extends through the formation to be fractured, a slot is cut through the casing and the surrounding sheath and a first packer is set immediately above the slot against the casing, thereby forming a packer-to-casing bond. The second packer is set against the casing. The hydraulic pressure and acoustical energy are applied in the fracture treatment zone as previously described. The packer-to-casing bonds are made to behave as rigid couplings under acoustic excitation and thus the vertical pressure applied to the packers is transferred via the casing and cement sheath to the formation penetrated by the well. The hydraulic pressure is applied via the slot to the formation face exposed thereto and the combination of hydraulic pressure and acoustically generated vertical stress results in the forming and propagation into the formation of a horizontally disposed fracture.

I claim:

1. A method of forming a horizontally disposed fracture in a subterranean formation that is penetrated by a borehole, comprisiing the steps of:

a. setting in said borehole against said formation an upper packer and a lower packer to form with each of said upper packer and lower packer a packer-to-formation bond with the wall of said formation and define with said borehole and intermediate said upper packer and said lower packer a fracture treatment zone;

b. applying hydraulic pressure to said fracture treatment zone in an amount slightly less than that pressure required to create a vertical fracture in said formation;

c. applying acoustical energy in said fracture treatment zone at a frequency to form a resonant condition therein and rigidly couple said upper packer and said lower packer with the wall of said formation and form a horizontal fracture in said formation; and d. propagating said horizontal fracture into said formation by continuing to apply hydraulic pressure to said fracture treatment zone.

2. The method of claim 1 wherein in step (d) said horizontal fracture is propagated into said formation by continuing to apply to said fracture treatment zone said hydraulic pressure and said acoustical energy.

3. The method of claim 1 wherein said fracture treatment zone has a vertical dimension of from 10 feet to 100 feet.

4. The method of claim 2 wherein acoustical energy is applied in said fracture treatment zone at a frequency within the range of 10 to 1000 cycles per second.

5. A method of forming a horizontally disposed fracture in a subterranean formation that has a preferred vertical fracture orientation and that is penetrated by a borehole, comprising the steps of:

a. setting in said borehole against said formation an upper packer and a lower packer to form with at least one of said packers a packer-to-formation bond with the wall of said formation and define with said borehole and intermediate said upper packer and said lower packer a fracture treatment zone having a vertical dimension of from 10 to 100 feet;

b. applying hydraulic pressure to said fracture treatment zone in an amount slightly less than that pressure required to create a vertical fracture in said formation; and c. applying acoustical energy in said fracture treatment zone such that the combined hydraulic and acoustical pressure therein is less than that pressure required to create a vertical fracture in said formation, said acoustical energy being applied at a frequency within the range of 10 to 1000 cycles per second to form a resonant condition therein and rigidly couple at least one of said packers with the wall of said formation and form a horizontal fracture in said formation.

* * * * *